United States Patent [19]

Becker

[11] Patent Number: 4,822,514

[45] Date of Patent: Apr. 18, 1989

[54] COMPOSITIONS AND METHODS FOR CLEANING SURFACES WHILE SELECTIVELY IMPARTING GLOSS OR SHINE THERETO

[75] Inventor: Brian D. Becker, Northfield, Ohio

[73] Assignee: Murphy-Phoenix Company, Cleveland, Ohio

[21] Appl. No.: 3,191

[22] Filed: Jan. 14, 1987

[51] Int. Cl.[4] ..... C11D 9/00

[52] U.S. Cl. ..... 252/108; 252/110; 252/111; 252/117; 252/118; 252/174.21; 252/546; 252/DIG. 14

[58] Field of Search ..... 252/DIG. 14, 111, 110, 252/108, 174.2, 546, 117, 118

[56] References Cited

U.S. PATENT DOCUMENTS

| | | | |
|---|---|---|---|
| 4,098,713 | 7/1978 | Jones | 252/174.21 |
| 4,530,775 | 7/1985 | Brierley et al. | 252/DIG. 14 |
| 4,564,463 | 1/1986 | Secemski et al. | 252/DIG. 14 |
| 4,608,189 | 8/1986 | Koch et al. | 252/DIG. 14 |
| 4,659,497 | 4/1987 | Akred et al. | 252/DIG. 14 |
| 4,678,606 | 7/1987 | Akhter et al. | 252/DIG. 14 |
| 4,704,233 | 11/1987 | Hartman et al. | 252/DIG. 14 |

FOREIGN PATENT DOCUMENTS

| | | | |
|---|---|---|---|
| 649742 | 2/1976 | U.S.S.R. | 252/117 |
| 617472 | 4/1976 | U.S.S.R. | 252/117 |

OTHER PUBLICATIONS

Technical Bulletin on "Pluracol V-10 Polyol", BASF Wyandotte Corp., N.J.

*Primary Examiner*—Asok Pal

*Attorney, Agent, or Firm*—Jones, Day, Reavis & Pogue

[57] ABSTRACT

A dilutable concentrate cleaning composition, a sprayable cleaning composition, and method of cleaning a surface, whereby a gloss or shine is imparted or restored to that surface if the surface initially presented a gloss or shine when clean, and cleaning of the surface is effected, comprising the application of an effective amount of the dilutable concentrate or sprayable cleaning compositions. No gloss or shine is imparted if the surface initially presented a dull or matte surface when clean.

22 Claims, No Drawings

COMPOSITIONS AND METHODS FOR CLEANING SURFACES WHILE SELECTIVELY IMPARTING GLOSS OR SHINE THERETO

FIELD OF THE INVENTION

The invention relates to the field of compositions for cleaning surfaces, particularly dilutable concentrated compositions and sprayable compositions useful for cleaning in a household environment.

BACKGROUND OF THE INVENTION—DISCLOSURE OF INFORMATION PURSUANT TO 37 CFR §§1.97-0.98

A vast number of cleaning materials have long been known which have potential application to the problem of the cleaning of objects and environments presenting a hard surface. Such objects and environments include wooden floors; floors covered with tile, linoleum or an equivalent covering; kitchen cabinets and other storage items, fixed or free standing; appliances, such as refrigerators, dishwashers, ranges, microwave ovens and the like; and furniture, such as tables, sideboards and the like. Known cleaning materials for use in cleaning such objects and environments range from natural soaps and detergents to more complex synthetic cleaning compositions. Known cleaning compositions may range from very mild furniture cleaners, to mild yet effective wax strippers, to harsh, powerful degreasers. In most instances, such compositions broadly comprise a surfactant system for soil penetration, loosening and emulsification, along with appropriate coupling agents and performance modifiers. In the case of degreasers, for example, solvents of various types may be used, including glycol ethers, petroleum solvents, glycols and/or alcohols. A mild product, in contrast, must usually avoid the use of strong solvents and lower molecular weight glycol ethers, while a wax stripper will include significant quantities of light amine and stronger glycol ethers.

Cleaning materials effective for use in household applications for cleaning hard surfaces, present specific problems relating both to convenience and simplicity of the use of the material and to its required performance and safety characteristics. The required performance characteristics also vary depending upon the inherent characteristics of the surface to be cleaned. Securing a cleaning material which provides the combination of convenience and simplicity of use, with the required performance and safety characteristics, has long been a desired objective which has often met with little success.

Broadly known household cleaning compositions generally consist of a non-ionic surfactant system (ethoxylated alcohols, amides and the like), alkaline builders (sodium carbonate, phosphates, silicates and the like), glycol ethers (ethylene, propylene, diethylene, and dipropylene glycol type ethers) and possibly a chelant (EDTA, citrate and the like).

Generally, for broad use and effectiveness, a cleaning composition must be chemically neutral to the surface which is being cleaned, and otherwise cause no adverse reaction or effect on said surface. This is a particular problem where a substantially solvent-based system is used in connection with a plastic, wood or composite surface, while the cleaning of metal or porcelain-coated metal surfaces may also be adversely affected if cleaned with a substantially alkaline system. These adverse effects can include dulling, scarring or streaking of the surface, or the dissolving of all or a portion of the surface, causing substantial and irreparable damage.

Even if chemically neutral, or effectively neutral to the surface being cleaned, a cleaning composition may dull the shine or gloss that the surface inherently possesses. Materials such as acrylic surfaces, laminated surfaces (bearing Formica brand or an equivalent laminate) and certain metal surfaces, either inherently or by prior treatment, display a desired gloss or shine when clean. It is the function of an effective cleaning composition for such a surface to remove grease, dirt and other deleterious substances, thereby cleaning the surface and restoring the inherent shine or gloss that the surface possesses when clean.

Conversely, a number of surfaces, either inherently or by design, present a dull or matte surface when clean. It is the function of an effective cleaning composition for such a surface to remove grease, dirt and other deleterious substances, thereby cleaning the surface, without imparting a gloss or shine to the surface when clean.

No known cleaning composition useful for the cleaning of hard surfaces, as described, presents the property of cleaning an inherently shiny or glossy surface, while restoring that shine or gloss, yet, when applied to clean an inherently dull or matte surface, cleans that surface without imparting undesired shine or gloss.

Cleaning compositions useful for household applications in cleaning hard surfaces must also display a number of other often conflicting properties and characteristics. In most instances, they should preferably be spray on/wipe off type cleaners. Because of the danger, undesirable odor and harshness, substantially non-aqueous solvent based compositions are undesirable, particularly all non-aqueous, strong organic solvent-based systems. Cleaning compositions must also be stable in storage and in use—no clouding, separation or precipitation of component materials from solution should occur. Of course, the cleaning composition must provide adequate cleaning function to clean and remove a variety of grease, dirt, carbonaceous soils, marking materials or ink, and other deleterious materials, particularly greasy and oily materials, encountered in a household environment from the surfaces described above. That cleaning must occur, however, without the composition streaking or otherwise leaving a film upon the cleaned surface. Of course, the composition must not possess an unpleasant or unacceptable odor—such as a heavy cleaner or detergent odor —either in use or upon the cleaned surface. If the product is sprayable, one must assume the probability of spray splattering into the user's eyes, and the product's causation of eye irritation must be negated or minimized as much as possible.

Particularly desirable in a cleaning composition for household applications in cleaning hard surface is the ability to formulate the composition in a variety of concentrations. A concentrated non-aqueous version of the composition may be desired for certain applications, while a more dilute, substantially milder, sprayable version of the composition may be desired for other applications. A sprayable composition, if water or substantially aqueous based, must not be too thin or runny, which will result in a scattered, messy and very unsatisfactory result, with the composition running off a vertical surface too quickly for cleaning to be carried out. If it is too thick or viscuous, however, a well-dispersed spray will be substantially impossible to secure and the composition will be substantially difficult to wipe off without leaving excessive residues—another undesired situation.

The known cleaning compositions do not present the desired combination of characteristics and performance properties described. There has long been an unfilled need for a cleaning composition, having particular efficacy in household applications, having the following optimum combination of charcteristics:

1. The ability to clean hard surfaces of a variety of materials encountered in a household environment, including but not limited to grease, dirt, carbonaceous soils, marking material or ink, and the like, without leaving a film or streaking the cleaned surface;

2. The ability to provide said cleaning action without deleterious effect on said hard surface, even if that surface comprises a finished wood having a varnished, sealed or painted surface, or a plastic material;

3. The ability to clean a hard surface, whereby a gloss or shine is imparted or restored only if said surface initially presented a gloss or shine when clean, but not to impart a gloss or shine if said surface initially presented a dull or matte surface when clean;

4. The ability to formulate said composition in a variety of viscosities ranging from a high strength concentrated version to a mild, substantially liquid (in water or a substantially aqueous carrier), sprayable version which has sufficient spray characteristics to avoid running off a vertical surface before cleaning can be accomplished; and 5. Lack of any objectionable odor.

No heretofore known cleaning composition provides this optimum combination of properties, which are particularly efficacious for household cleaning applications.

SUMMARY OF INVENTION

The invention provides the combination of characteristics and performance properties heretofore absent from known cleaning compositions for hard surface applications. The invention comprises a dilutable concentrate cleaning composition, which may be used as is or diluted with water or a substantially aqueous liquid carrier to the desired concentration and/or viscosity, comprising:

a. from about 5 to about 25 wt % of at least one alkaline metal salt of a fatty acid;

b. from about 5 to about 25 wt % of at least one alkanolamine salt of a fatty acid;

c. from about 5 to about 20 wt % of a component selected from the group consisting of a fatty acid alkanol amide, having an acid/amine ratio of from about 1:1 to about 2:1; an ethoxylated linear alcohol, having from about 7 to about 12 moles ethylene oxide and an average linear chain portion length of from about 10 to about 18 carbon atoms, and mixtures thereof;

d. from about 25 to about 60 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; dipropylene glycol ethyl ether; dipropylene glycol propyl ether, and mixtures thereof;

e. from about 5 to about 25 wt % of a polyalkoxylated alkylolalkane; and f. from about 0.2 to about 2.0 wt % of a compound selected from the group consisting of the sodium salts of EDTA, HEDTA, and mixtures thereof.

The invention also comprises a sprayable cleaning composition comprising:

a. from about 0.5 to about 5 wt % of at least one alkaline metal salt of a fatty acid;

b. from about 0.5 to about 5 wt % of at least one alkanalomine salt of a fatty acid;

c. from about 0.5 to about 2 wt % of a component selected from the group consisting of a fatty acid alkanol amide, having an acid/amine ratio of from about 1:1 to about 2:1; an ethoxylated linear alcohol, having from about 7 to about 12 moles ethylene oxide and an average linear chain portion length of from about 10 to about 18 carbon atoms, and mixtures thereof;

d. from about 0.5 to about 10 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; diproylene glycol ethyl ether; dipropylene glycol propyl ether, and mixtures thereof;

e. from about 0.5 to about 2.5 wt % of a polyalkoxylated alkylolalkane;

f. from about 0.02 to about 0.2 wt % of a compound selected from the group consisting of the sodium salts of EDTA, HEDTA, and mixtures thereof; and g. the balance of 100 wt % of a liquid carrier, selected from the group consisting of water, and an aqueous composition comprising at least about 80 wt % water.

The invention further comprises a method of cleaning a surface, whereby a gloss or shine is imparted or restored to said surface if said surface initially presented a shine or gloss when clean and cleaning of said surface is effected, comprising the application of a dilutable concentrated cleaning composition comprising:

a. from about 5 to about 25 wt % of at least one alkaline metal salt of a fatty acid;

b. from about 5 to about 25 wt % of at least one alkanolamine salt of a fatty acid;

c. from about 5 to about 20 wt % of a component selected from the group consisting of a fatty acid alkanol amide, having an acid/amine ratio of from about 1:1 to about 2:1; an ethoxylated linear alcohol, having from about 7 to about 12 moles ethylene oxide and an average linear chain portion length of from about 10 to about 18 carbon atoms, and mixtures thereof;

d. from about 25 to about 60 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; dipropylene glycol ethyl ether; dipropylene glycol propyl ether, and mixtures thereof;

e. from about 5 to about 25 wt % of a polyalkoxylated alkylolalkane; and f. from about 0.2 to about 2.0 wt % of a compound selected from the group consisting of the sodium salts of EDTA, HEDTA, and mixtures thereof.

Alternatively, said concentrated cleaning compositions can be diluted to a desired concentration or viscosity by mixture with water or any aqueous composition comprising at least about 80 wt % water.

The invention also comprises another alternative method of cleaning a surface, whereby a gloss or shine is imparted or restored to said surface if said surface initially presented a shine or gloss when clean and cleaning of said surface is effected, comprising the application of an effective amount of a sprayable cleaning composition comprising:

a. from about 0.5 to about 5.0 wt % of at least one alkaline metal salt of a fatty acid;

b. from about 0.5 to about 5.0 wt % of at least one alkanolamine salt of a fatty acid;

c. from about 0.5 to about 2.0 wt % of a component selected from the group consisting of a fatty acid alkanol amide, having an acid/amine ratio of from about 1:1 to about 2:1; an ethoxylated linear alcohol, having from about 7 to about 12 moles ethylene oxide and an average linear chain portion length of from about 10 to about 18 carbon atoms, and mixtures thereof;

d. from about 0.5 to about 10 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; dipropylene glycol ethyl ether; dipropylene glycol propyl ether, and mixtures thereof;

e. from about 0.5 to about 2.5 wt % of a polyalkoxylated alkylolalkane;

f. from about 0.02 to about 0.2 wt % of a compound selected from the group consisting of the sodium salts of EDTA, HEDTA, and mixtures thereof; and g. the balance to 100 wt % of a liquid carrier, selected from the group consisting of water, and an aqueous composition comprising at least about 80 wt % water.

An "effective amount" of either the dilutable concentrate cleaning composition or the sprayable cleaning composition, is that quantity which, when applied to the surface to be cleaned and spread thereon with wiping, rubbing, scrubbing or equivalent motion, removes the grease, dirt or other deleterious or undesired substances present thereon and/or imparts the desired gloss or shine to said surface. Multiple applications of the dilutable concentrate or sprayable cleaning composition may serve to make up an "effective amount", particularly where the surface to be cleaned is especially greasy or dirty, or has become especially clouded or dulled from its inherent gloss or shine.

The invention further comprises the use or inclusion in a dilutable concentrate cleaning composition, and/or a sprayable cleaning composition, and, more generally, in a cleaning composition wherein the characteristic of imparting or restoring a gloss or shine to a surface if said surface initially presented a shine or gloss when clean, of a polyalkoxylated trimethylolpropane derivative.

It is therefore an object of this invention to provide a novel, safe cleaning composition able to clean hard surfaces of a variety of undesired materials encountered in a household environment, without leaving a film or streaking the surface once cleaned and without deleterious effect on said hard surface, even if that surface comprises a finished wood having a varnished, sealed or painted surface, or a plastic material.

It is another object of this invention to provide a novel cleaning composition which imparts or restores a gloss or shine to a hard surface being cleaned, if said surface initially presented a gloss or shine when clean, but does not impart a gloss or shine to the surface cleaned if said surface initially presented a dull or matte surface when clean.

It is yet another object of this invention to provide a novel cleaning composition satisfying the aforesaid objectives and capable of formulation in a variety of viscosities, ranging from a concentrated version to a milder, substantially liquid (in water or a substantially aqueous carrier), sprayable or "spray on/wipe off" version, which has sufficient viscosity to avoid running off a vertical surface before cleaning can be accomplished.

Other objects and advantages of this invention will become apparent upon reading the following detailed description and appended claims.

DESCRIPTION OF THE PREFERRED EMBODIMENT

A preferred dilutable concentrate cleaning composition of the invention comprises:

a. from about 8 to about 12 wt % of at least one alkaline metal salt of a fatty acid;

b. from about 12 to about 20 wt % of at least one alkanolamine salt of a fatty acid;

c. from about 6 to about 15 wt % of a component selected from the group consisting of a fatty acid alkanolamide, having an acid/amine ratio of from about 1:1 to about 2:1; an ethoxylated linear alcohol, having from about 7 to about 12 moles ethylene oxide and an average linear chain portion length of from about 10 to about 18 carbon atoms, and mixtures thereof;

d. from about 35 to about 60 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; dipropylene glycol ethyl ether; dipropylene glycol propyl ether, and mixtures thereof;

e. from about 10 to about 15 wt % of a polyalkoxylated alkylolalkane; and f. from about 0.5 to about 1.5 wt % of a compound selected from the group consisting of the sodium salts of EDTA, HEDTA, and mixtures thereof.

A particularly preferred dilutable concentrate cleaning composition of the invention comprises:

a. from about 8 to about 12 wt % of at least one potassium salt of a fatty acid selected from the group consisting of refined tall oil, soya, peanut, corn, cottonseed, linseed, and refined oleic fatty acids, and mixtures thereof;

b. from about 12 to about 20 wt % of at least one triethanolamine salt of a vegetable oil fatty acid;

c. from about 6 to about 15 wt % of coconut oil diethanolamide;

d. from about 35 to about 60 wt % of tripropylene glycol methyl ether;

e. from about 10 to about 15 wt % of a polyalkoxylated trimethylolpropane derivative; and f. from about 0.5 to about 1.5 wt % of trisodium EDTA.

The optimum dilutable concentrate cleaning composition of the invention comprises:

a. about 13 wt % of a triethanolamine salt of refined tall oil;

b. about 8.5 wt % of a potassium salt of refined tall oil;

c. about 38 wt % of tripropylene glycol methyl ether;

d. about 16 wt % of triethanolamine;

e. about 8 wt % of coconut oil diethanolamide;

f. about 11 wt % of a polyalkoxylated trimethylolpropane derivative;

g. about 1 wt % disodium EDTA; and h. about 2 to about 6 wt % fragrance.

A preferred sprayable cleaning composition of the invention comprises:

a. from about 0.6 to about 1 wt % of at least one alkaline metal salt of a fatty acid;

b. from about 1.0 to about 1.5 wt % of at least one alkanolamine salt of a fatty acid;

c. from about 0.5 to about 1 wt % of a component selected from the group consisting of a fatty acid alkanolamide, having an acid/amine ratio of from about 1:1 to about 2:1; an ethoxylated linear alcohol, having from about 7 to about 12 moles ethylene oxide and an average linear chain portion length of from about 10 to about 18 carbon atoms, and mixtures thereof;

d. from about 3 to about 4 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; dipropylene glycol ethyl ether; dipropylene glycol propyl ether, and mixtures thereof;

e. from about 0.8 to about 1.2 wt % of a polyalkoxylated alkylolalkane derivative;

f. from about 0.06 to about 0.1 wt % of a compound selected from the group consisting of the sodium salts of EDTA, HEDTA, and mixtures thereof; and g. the balance to 100 wt % of a liquid carrier, selected from the group consisting of water and an aqueous composition comprising at least about 85 wt % water.

A particularly preferred sprayable cleaning composition of the invention comprises:

a. from about 0.6 to about 1 wt % of at least one potassium salt of a fatty acid selected from the group consisting of refined tall oil, soya, peanut, corn, cottonseed, linseed, and refined oleic fatty acids, and mixtures thereof;

b. from about 1.0 to about 1.5 wt % of at least one triethanolamine salt of a vegetable oil fatty acid;

c. from about 0.5 to about 1 wt % of coconut oil diethanolamide;

d. from about 3 to about 4 wt % of tripropylene glycol methyl ether;

e. from about 0.8 to about 1.2 wt % of a polyalkoxylated trimethylolpropane derivative;

f. from about 0.06 to about 0.1 wt % of trisodium EDTA; and g. The balance to 100 wt % of a liquid carrier, selected from the group consisting of water and an aqueous composition comprising at least about 85 wt % water.

An optimum sprayable cleaning composition of the invention comprises:

a. about 1.2 wt % of a triethanolamine salt of refined tall oil;

b. about 0.8 wt % of a potassium salt of refined tall oil;

c. about 3.5 wt % of tripropylene glycol methyl ether;

d. about 1.5 wt % of triethanolamine;

e. about 0.75 wt % of coconut oil diethanolamide;

f. about 1 wt % of a polyalkoxylated trimethylolpropane derivative;

g. about 0.08 wt % disodium EDTA;

h. about 0.2 to about 0.5 wt % fragrance; and i. the balance to 100 wt % of a liquid carrier, selected from the group consisting of water and an aqueous composition comprising at least about 90 wt % water.

The optimum sprayable cleaning composition of the invention may be alternatively described through the raw materials mixed and formulated to prepare the final composition. Said raw materials comprise:

| Ingredient | CAS # | Tradename | Wt % |
|---|---|---|---|
| Refined Tall Oil | 61790-12-3 | | about 1.5% |
| Tripropylene glycol monomethyl ether | 112-35-6 | Dowanol TPM | about 3.5% |
| Triethanolamine | 102-71-6 | | about 2.0% |
| Coconut-Diethanolamide (1:1) | 68603-42-9 | Clindrol 100 C-G | about 0.75% |
| Polyalkoxylated trimethylolpropane | 52624-57-4 | Pluracol V-10 | about 1.0% |
| Caustic potash (KOH) | 1310-58-6 | | about 0.3% |
| Tetrasodium EDTA (40% solution) | 64-02-8 | Versene 100 | about 0.2% |
| Fragrance | about 0.36% P-250<br>about 0.04% Geraniol 500 | | about 0.4% |
| Water | | | Q.S. |

When mixed, it is believed that the following composition results:

| Component | CAS # | Tradename | Wt % |
|---|---|---|---|
| Triethanolamine salt of refined tall oil (triethanolamine oleate) | 2717-15-9 | | about 1.2% |
| Potassium salt of refined tall oil | 61790-44-1 | | about 0.8% |
| Tripropylene glycol monomethyl ether | 112-35-6 | Dowanol TPM | about 3.5% |
| Triethanolamine | 102-71-6 | | about 1.5% |
| Coconut diethanolamide | 68603-42-9 | Clindrol 100 C-G | about 0.75% |
| Polyalkoxylated trimethylolpropane | 52624-57-4 | Pluracol V-10 | about 1.0% |
| Disodium EDTA | 64-02-8 | | about 0.08% |
| Fragrance | about 0.36% P-250<br>about 0.04% Geraniol 500 | | about 0.4% |
| Water | | | Q.S. |

While the cleaning and selective gloss or shine imparting or restoring mechanism of the novel composition of the invention is not completely understood, the presence of a polyalkoxylated alkylolalkane, particularly a polyalkoxylated trimethylolpropane derivative, is critical. A BASF Wyandotte product, having CAS Number 52624-57-4, and the tradename Pluracol V-10, which is identified as oxirane, methyl-polymer with oxirane, ether with 2-ethyl-2-(hydroxymethyl)-1,3-propanediol (3:1), comprises a particular polyalkoxylated trimethylolpropane derivative useful in the composition and method of the invention. It is further believed that an interaction, in at least some measure synergistic, exists between the polyalkoxylated alkylolalkane and the all vegetable-oil derived surfactant/detergent components present in the preferred compositions of the invention (the triethanolamine salt of refined tall oil (triethanolamine oleate), the potassium salt of refined tall oil, and the coconut oil diethanolamide). The use of one or more synthetic detergent components will not, it is further believed, provide the optimum combination of properties which the particularly preferred and optimum compositions of the invention provide.

It is also believed that the triethanolamine salt of refined tall oil (triethanolamine oleate) functions as a surfactant and emulsifier with respect to the dirt to be cleansed from the subject surface; the potassium salt of refined tall oil functions not only as a surfactant and emulsifier with respect to the dirt to be cleansed from the subject surface, but also acts to prevent redeposition of the removed dirt, so as to prevent streaking and filming of the surface; and the coconut oil diethanolamide functions not only as a surfactant and emulsifier with respect to the dirt to be cleansed from the subject surface, but also acts as a foam stabilizer, to allow the composition to foam during application, particularly when sprayed upon the surface to be cleaned, and wiping, rubbing and/or scrubbing to an acceptable level, but to no greater extent. Finally, it is believed that the polyalkoxylated alkylolalkane functions not only as a selective gloss agent, but also to modify the composition rheology.

While alkaline metal and organic salts of refined tall oil are particularly preferred as components of the compositions of the invention, other substantially unsaturated vegetable oil fatty acids, including soya, peanut, corn, cottonseed, linseed and refined oleic fatty acids, and fatty acids consisting predominantly of $C_{18}$ (average) unsaturated fatty acids, and mixtures thereof, may be used. Similarly, while coconut oil diethanolamide (1:1) is also preferred as a component of the composition of the invention, fatty acid alkanolamides having an acid/base substituent ratio of between about 1:1 and 2:1, or, ethoxylated linear alcohols having from about 7 to about 12 moles of ethylene oxide and an average carbon chain length of about $C_{10}$ to about $C_{18}$ may be used. And, while tripropylene glycol methyl ether is preferred as a component of the compositions of the invention, other polyol alkyl ethers, including diethylene and dipropylene glycol, monomethyl, ethyl or butyl ethers, may be used.

While particular embodiments of the invention, and the best mode contemplated by the inventor for carrying out the invention, have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

I claim:

1. A dilutable concentrate cleaning composition consisting essentially of:

a. from about 5 to about 25 wt % of at least one alkaline metal sale of a fatty acid;

b. from about 5 to about 25 wt % of at least one alkanolamine salt of a fatty acid;

c. from about 5 to about 25 wt % of a component selected from the group consisting of a fatty acid alkanolamide, having an acid amine ratio of from about 1:1 to about 2:1; an ethoxylated linear alcohol; having from about 7 to about 12 moles ethylene oxide and an average linear chain portion length of from about 10 to about 18 carbon atoms, and mixtures thereof;

d. from about 25 to about 60 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; dipropylene glycol ethyl ether; dipropylene glycol propyl ether, and mixtures thereof;

e. from about 5 to about 25 wt % of a compound selected from the group consisting of polyalkoxylated alkyloalkane comprising ethoxy and propoxy groups and derivatives thereof; and f. from about 0.2 to about 2.0 wt % of a compound selected from the group consisting of the sodium salts of EDTA, HEDTA, and mixtures thereof.

2. The dilutable concentrate composition of claim 1, wherein said composition further includes from about 0 to about 25 wt % of an alkanolamine, and from about 0 to about 10 wt % fragrance.

3. The dilutable concentrate cleaning composition of claim 1 consisting essentially of:

a. from about 8 to about 12 wt % of at least one alkaline metal salt of a fatty acid;

b. from about 12 to about 20 wt % of at least one alkanolamine salt of a fatty acid;

c. from about 6 to about 15 wt % of a component selected from the group consisting of a fatty acid alkanolamide, having an acid amine ratio of from about 1:1 to about 2:1; an ethoxylated linear alcohol, having from about 7 to about 12 moles ethylene oxide and an average linear chain portion length of from about 10 to about 18 carbon atoms, and mixtures thereof d. from about 30 to about 60 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; dipropylene glycol ethyl ether; diepropylene glycol propyl ether, and mixtures thereof;

e. from about 10 to about 15 wt % of a compound selected from the group consisting of polyalkoxylated alkyloalkane comprising ethoxy and propoxy groups and derivatives thereof; and f. from about 0.5 to about 1.5 wt % of a compound selected from the group consisting of the sodium salts of EDTA, HEDTA, and mixtures thereof.

4. The dilutable concentrate composition of claim 3, wherein said composition further includes from about 5 to about 20 wt % of an alkanolamine, and from about 3 to about 6 wt % fragrance.

5. The dilutable concentrate cleaning composition of claim 1 consisting essentially of:

a. from about 8 to about 12 wt % of at lesat one potassium salt of a fatty acid selected from the group consisting of a refined tall oil, soya, peanut, corn, cottonseed, linseed and refined oleic fatty acid, and mixtures thereof;

b. from about 12 to about 20 wt % of at least one triethanolamine salt of a refined tall oil fatty acid;

c. from about 6 to about 15 wt % of coconut oil diethanolamide;

d. from about 40 to about 60 wt % of tripropylene glycol methyl ether;

e. from about 10 to about 15 wt % of a polyalkoxylated trimethylolpropane comprising ethoxy and propoxy groups; and f. from about 0.5 to about 1.5% of trisodium EDTA.

6. The dilutable concentrate composition of claim 5, wherein said composition further includes from about 5 to about 20 wt % of triethanolamine and from about 3 to about 6 wt % fragrance.

7. A dilutable concentrate cleaning composition consisting essentially of:

a. about 13 wt % of a triethanolamine salt of refined tall oil;
b. about 8.5 wt % of a potassium salt of refined tall oil;
c. about 38 wt % of tripropylene glycol methyl ether;
d. about 16 wt % of triethanolamine;
e. about 8 wt % of coconut oil diethanolamide;
f. about 11 wt % of a polyalkoxylated trimethylolpropane comprising ethoxy and propoxy groups;
g. about 1 wt % disodium EDTA; and
h. about 2 to about 6 wt % fragrance.

8. A sprayable cleaning composition consisting essentially of:

a. from about 0.5 to about 5 wt % of at least one alkaline metal salt of a fatty acid;
b. from about 0.5 to about 5 wt % of at least one alkanolamine salt of a fatty acid;
c. from about 0.5 to about 2 wt % of a component selected from the group consisting of a fatty acid alkanolamide, having an acid amine ration of from about 1:1 to about 2:1; an ethoxylated linear alcohol, having from about 7 to about 12 moles ethylene oxide and an average linear chain portion length of from about 10 to about 18 carbon atoms, and mixtures thereof;
d. from about 0.5 to about 10 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; dipropylene glycol ethyl ether; dipropylene glycol propyl ether, and mixtures thereof;
e. from about 0.5 to about 2.5 wt % of a compound selected from the group consisting of polyalkoxylated alkyloalkane comprising ethoxy and propoxy groups and derivatives thereof;
f. from about 0.02 to about 0.2 wt % of a compound selected from the group consisting of the sodium salts of EDTA, HEDTA, and mixtures thereof; and the balance to 100% of a liquid carrier, selected from the group consisting of water and an aqueous composition comprising at least about 85 wt % water.

9. The sprayable cleaning composition of claim 8, wherein said composition further includes from about 0 to about 2.5 wt % of an alkanolamine, and from about 0 to about 2 wt % fragrance.

10. The sprayable cleaning composition of claim 8 consisting essentially of:

a. from about 0.6 to about 1 wt % of at least one alkaline metal salt of a fatty acid;
b. from about 1.0 to about 1.5 wt % of at leatnmc one alkanolamine salt of a fatty acid;
c. from about 0.5 to about 1 wt % of a component selected from the group consisting of a fatty acid alkanolamide, having an acid amine ratio of from about 1:1 to about 2:1; an ethoxylated linear alcohol, having from about 7 to about 12 moles ethylene oxide and an average linear chain portion length of from about 10 to about 18 carbon atoms, and mixtures thereof;
d. from about 3 to about 4 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; dipropylene glycol ethyl ether; propylene glycol propyl ether, and mixtures thereof;
e. from about 0.8 to about 1.2 wt % of a compound selected from the group consisting of polyalkoxylated alkyloalkane comprising ethoxy and propoxy groups and derivatives thereof;
f. from about 0.06 to about 0.1 wt % of a compound selected from the group consisting of the sodium salts of EDTA, HEDTA, and mixtures thereof; and
g. the balance to 100 wt % of a liquid carrier, selected from the group consisting of water, and an aqueous composition comprising at least about 85 wt % water.

11. The sprayable cleaning composition of claim 10, wherein said composition further includes from about 0.5 to about 1.5 wt % of an alkanolamine, and from about 0.3 to about 0.5 wt % fragrance.

12. The sprayable cleaning composition of claim 8 consisting essentially of:

a. from about 0.6 to about 1.0 wt % of at least one potassium salt of a fatty acid selected from the group consisting of a refined tall oil, soya, peanut, corn, cottonseed, linseed and refined oleic fatty acid, and mixtures thereof;
b. from about 1.0 to about 1.5 wt % of at least one triethanolamine salt of a refined tall oil fatty acid;
c. from about 0.5 to about 1.0 wt % of coconut oil diethanolamide;
d. from about 3.0 to about 4.0 wt % of tripropylene glycol methyl ether;
e. from about 0.8 to about 1.2 wt % of a polyalkoxylated trimethylolpropane comprising ethoxy and propoxy groups;
f. from about 0.6 to about 0.1 wt % of disodium EDTA; and
g. the balance to 100 wt % of a liquid carrier, selected from the group consisting of water and an aqueous composition comprising at least about 85 wt % water.

13. The sprayable cleaning composition of claim 12, wherein said composition further includes from about 0.5 to about 1.5 wt % of an alkanolamine, and from about 0.3 to about 0.5 wt % fragrance.

14. A sprayable cleaning composition consisting essentially of:

a. about 1.2 wt % of a triethanolamine salt of a refined tall oil;
b. about 0.8 wt % of a potassium salt of refined tall oil;
c. about 3.5 wt % of tripropylene glycol methyl ether;
d. about 1.5 wt % of triethanolamine;
e. about 0.75 wt % of coconut oil diethanolamide;
f. about 1 wt % of a polyalkoxylated trimethylolpropane comprising ethoxy and propoxy groups;
g. about 0.2 to about 0.5 wt % fragrance; and
h. the balance to 100 wt % of a liquid carrier, selected from the group consisting of water and an aqueous composition comprising at least about 85 wt % water.

15. A method of cleaning a surface, whereby a gloss or shine is imparted or restored to said surface if said surface initially presented gloss or shine when clean, and cleaning of said surface is effected, comprising the application of an effective amount to clean said surface of a dilutable concentrated cleaning composition consisting essentially of:

a. from about 5 to about 25 wt % of at least one alkaline metal salt of a fatty acid;
b. from about 5 to about 25 wt % of at least one alkanolamine salt of a fatty acid;
c. from about 5 to about 20 wt % of a component selected from the group consisting of a fatty acid alkanolamide, having an acid amine ratio of from about 1:1 to about 2:1; an ethoxylated linear alcohol, having from about 7 to about 12 moles ethylene oxide and an average linear chain portion length of from about 10 to about 18 carbon atoms, and mixtures thereof;
d. from about 25 to about 60 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; dipropylene glycol ethyl ether; dipropylene glycol propyl ether, and mixtures thereof;
e. from about 5 to about 25 wt % of a compound selected from the group consisting of polyalkoxylated alkyloalkane comprising ethoxy and propoxy groups and derivatives thereof; and
f. from about 0.2 to about 2 wt % of a compound selected from the group consisting of the sodium salts of EDTA, HEDTA, and mixtures thereof.

16. A method of cleaning a surface, whereby a gloss or shine is imparted or restored to said surface if said surface initially presented a gloss or shine when clean, and cleaning of said surface is effected, comprising the application of an effective amount to clean said surface of a sprayable cleaning composition consisting essentially of:

a. from about 0.5 to about 5 wt % of at least one alkaline metal salt of a fatty acid;
b. from about 0.5 to about 5 wt % of at least one alkanolamine salt of a fatty acid;
c. from about 0.5 to about 2 wt % of a component selected from the group consisting of a fatty acid alkanolamide, having an acid amine ratio of from about 1:1 to about 2:1; an ethoxylated linear alcohol, having from about 7 to about 12 moles ethylene oxide and an average linear chain portion length of from about 10 to about 18 carbon atoms, and mixtures thereof;
d. from about 0.5 to about 10 wt % of a substituted ether selected from the group consisting of tripropylene glycol methyl ether; tripropylene glycol ethyl ether; tripropylene glycol butyl ether; diethylene glycol methyl ether; diethylene glycol ethyl ether, diethylene glycol butyl ether; dipropylene glycol methyl ether; dipropylene glycol ethyl ether; dipropylene glycol propyl ether, and mixtures thereof;
e. from about 0.5 to about 2.5 wt % of a compound selected from the group consisting of polyalkoxylated alkyloalkane comprising ethoxy and propoxy groups and derivatives thereof;
f. from about 0.02 to about 0.2 wt % of a compound selected from the group consisting of the sodium salts of EDTA, HEDTA, and mixtures thereof; and
g. the balance to 100 wt % of a liquid carrier, selected from the group consisting of water and an aqueous composition comprising at least about 85 wt % water.

17. A method of cleaning a surface of claim 15, whereby a gloss or shine is imparted or restored to said surface if said surface initially presented a gloss or shine when clean, and cleaning of said surface is effected, comprising the application of an effective amount to clean said surface of a dilutable concentrated cleaning composition consisting essentially of:

a. from about 8 to about 12 wt % of at least one alkaline metal salt of a fatty acid;
b. from about 12 to about 20 wt % of at least one alkanolamine salt of a fatty acid;
c. from about 6 to about 15 wt % of a component selected from the group consisting of a fatty acid alkanolamide, having an acid amine ratio of from about 1:1 to about 2:1; an ethoxylated linear alcohol , having from about 7 to about 12 moles ethylene oxide and an average linear chain portion length of from about 10 to about 18 carbon atoms, and mixtures thereof;
d. from about 30 to about 60 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; dipropylene glycol ethyl ether; dipropylene glycol propyl ether, and mixtures thereof;
e. from about 10 to about 15 wt % of a compound selected from the group consisting of polyalkoxylated alkyloalkane comprising ethoxy and propoxy groups and derivatives thereof; and
f. from about 0.5 to about 1.5 wt % of a compound selected from the group consisting of the sodium salts of EDTA, HEDTA, and mixtures thereof.

18. A method of cleaning a surface of claim 16, whereby a gloss or shine is imparted or restored to said surface if said surface initially presented a gloss or shine when clean, and cleaning of said surface is effected, comprising the application of an effective amount to clean said surface of a sprayable cleaning composition consisting essentially of:

a. from about 0.6 to about 1 wt % of at least one alkaline metal salt of a fatty acid;
b. from about 1 to about 1.5 wt % of at least one alkanolamine salt of a fatty acid;
c. from about 0.5 to about 1 wt % of a component selected from the group consisting of a fatty acid alkanolamide, having an acid amine ratio of from about 1:1 to about 2:1; an ethoxylated linear alcohol, having from about 7 to about 12 moles ethylene oxide and an average linear chain portion length of from about 10 to about 18 carbon atoms, and mixtures thereof;
d. from about 3 to about 4 wt % of a substituted ether selected from the group consisting of tripropylene glycol methyl ether; tripropylene glycol ethyl ether; tripropylene glycol butyl ether; diethylene glycol methyl ether; diethylene glycol ethyl ether; diethylene glycol butyl ether; dipropylene glycol methyl ether; dipropylene glycol ethyl ether; dipropylene glycol propyl ether, and mixtures thereof;

e. from about 0.8 to about 1.2 wt % of a compound selected from the group consisting of polyalkoxylated alkyloalkane comprising ethoxy and propoxy groups and derivatives thereof;

f. from about 0.06 to about 0.1 wt % of a compound selected from the group consisting of the sodium salts of EDTA, HEDTA, and mixtures thereof; and g. the balance to 100 wt % of a liquid carrier, selected from the group consisting of water and an aqueous composition comprising at least about 85 wt % water.

19. A method of cleaning a surface of claim 15, whereby a gloss or shine is imparted or restored to said surface if said surface initially presented a gloss or shine when clean, and cleaning of said surface is effected, comprising the application of an effective amount to clean said surface of a dilutable concentrated cleaning composition consisting essentially of:

a. from about 8 to about 12 wt % of at least one potassium salt of a fatty acid selected from the group consisting of a refined tall oil, soya, peanut, corn, cottonseed, linseed and refined oleic fatty acid, and mixtures thereof;

b. from about 12 to about 20 wt % of at least one triethanolamine salt of a refined tall oil fatty acid;

c. from about 6 to about 5 wt % of coconut oil diethanolamide;

d. from about 30 to about 60 wt % of tripropylene glycol methyl ether;

e. from about 10 to about 15 wt % of a polyalkoxylated trimethylolpropane comprising ethoxy and propoxy groups; and

20. A method of cleaning a surface of claim 16, whereby a gloss or shine is imparted or restored to said surface if said surface initially presented a gloss or shine when clean, and cleaning of said surface is effected, comprising the application of an effective amount to clean said surface of a sprayable cleaning composition consisting essentially of:

a. from about 0.6 to about 1 wt % of at least one potassium salt of a fatty acid selected from the group consisting of a refined tall oil, soya, peanut, corn, cottonseed, linseed and refined oleic fatty acid, and mixtures thereof;

b. from about 1 to about 1.5 wt % of at least one triethanolamine salt of a refined tall oil fatty acid;

c. from about 0.5 to about 1 wt % of coconut oil diethanolamide;

d. from about 3 to about 4 wt % of tripropylene glycol methyl ether;

e. from about 0.8 to about 1.2 wt % of a polyalkoxylated trimethylolpropane comprising ethoxy and propoxy groups;

f. from about 0.06 to about 0.1 wt % of trisodium EDTA; and g. the balance to 100 wt % of a liquid carrier, selected from the group consisting of water and an aqueous composition comprising at least about 85 wt % water.

21. The method of cleaning a surface of claim 15, whereby a gloss or shine is imparted or restored to said surface if said surface initially presented a gloss or shine when clean, and cleaning of said surface is effected, comprising the application of an effective amount to clean said surface of a dilutable concentrated cleaning composition consisting essentially of:

a. about 13 wt % of a triethanolamine salt of refined tall oil b. about 8.5 wt % of a potassium salt of refined tall oil;

c. about 38 wt % of tripropylene glycol methyl ether;

d. about 16 wt % of triethanolamine;

e. about 8 wt % of coconut oil diethanolamide;

f. about 11 wt % of a polyalkoxylated trimethylolpropane comprising ethoxy and propoxy groups;

g. about 1 wt % disodium EDTA; and h. about 2 to about 6 wt % fragrance.

22. The method of cleaning a surface of claim 16, whereby a gloss or shine is imparted or restored to said surface if said surface initially presented a gloss or shine when clean, and cleaning of said surface is effected, comprising the application of an effective amount to clean said surface of a dilutable concentrated cleaning composition consisting essentially of:

a. about 1.2 wt % of a triethanolamine salt of refined tall oil;

b. about 0.8 wt % of a potassium salt of refined tall oil;

c. about 3.5 wt % of tripropyleneglycol methyl ether;

d. about 1.5 wt % of triethanolamine;

e. about 0.75 wt % of coconut oil diethanolamide;

f. about 1 wt % of a polyalkoxylated trimethylolpropane comprising ethoxy and propoxy groups;

g. about 0.08 wt % disodium EDTA;

h. about 0.2 to about 0.5 wt % fragrance; and i. the balance to 100 wt % of a liquid carrier, selected from the group consisting of water and an aqueous composition comprising at least about 90 wt % water.

* * * * *